US005920292A

United States Patent [19]

O'Neill, Jr.

[11] Patent Number: 5,920,292

[45] Date of Patent: Jul. 6, 1999

[54] L-BAND QUADRIFILAR HELIX ANTENNA

[75] Inventor: Gregory A. O'Neill, Jr., Apex, N.C.

[73] Assignee: Ericsson Inc., Research Triangle Park, N.C.

[21] Appl. No.: 08/770,399

[22] Filed: Dec. 20, 1996

[51] Int. Cl.[6] ..... H01Q 1/36

[52] U.S. Cl. ..... 343/895; 343/894; 343/702; 343/713; 343/796; 343/727

[58] Field of Search ..... 343/895, 894, 343/702, 713, 796, 729

[56] References Cited

U.S. PATENT DOCUMENTS

| | | | |
|---|---|---|---|
| 3,083,364 | 3/1963 | Scheldorf | 363/967 |
| 4,008,479 | 2/1977 | Smith | 343/895 |
| 4,012,744 | 3/1977 | Grieser | 343/895 |
| 4,031,540 | 6/1977 | Borys, Jr. | 343/860 |
| 4,103,304 | 7/1978 | Burnham et al. | 343/113 R |
| 4,349,824 | 9/1982 | Harris | 343/700 |
| 4,554,554 | 11/1985 | Oelsen et al. | 343/895 |
| 4,608,574 | 8/1986 | Webster et al. | 343/895 |
| 4,672,686 | 6/1987 | Raoux et al. | 343/867 |
| 4,780,727 | 10/1988 | Seal et al. | 343/895 |
| 4,827,270 | 5/1989 | Udagawa et al. | 343/853 |
| 5,054,114 | 10/1991 | Erickson | 343/895 |
| 5,138,331 | 8/1992 | Josypenko | 343/895 |
| 5,170,176 | 12/1992 | Yasunaga et al. | 343/895 |
| 5,191,352 | 3/1993 | Branson | 343/895 |
| 5,198,831 | 3/1993 | Burrell et al. | 343/895 |
| 5,255,005 | 10/1993 | Terret et al. | 343/895 |
| 5,349,365 | 9/1994 | Ow et al. | 343/895 |
| 5,444,455 | 8/1995 | Louzir et al. | 343/895 |
| 5,485,170 | 1/1996 | McCarrick | 343/895 |

(List continued on next page.)

FOREIGN PATENT DOCUMENTS

| | | | |
|---|---|---|---|
| 0 593 185 A1 | 1/1993 | European Pat. Off. . | |
| 0 320 404 B1 | 3/1993 | European Pat. Off. . | |
| 0 632 603 A1 | 6/1994 | European Pat. Off. . | |
| 0791978 | 2/1996 | European Pat. Off. | 343/895 |
| 0 729 239 A1 | 8/1996 | European Pat. Off. . | |
| 0 427 654 A1 | 7/1990 | France . | |
| WO 90/13152 | 11/1990 | WIPO . | |
| WO 98/05087 | 2/1998 | WIPO . | |
| WO 98/05090 | 2/1998 | WIPO . | |

OTHER PUBLICATIONS

R. M. Fano, *Theoretical Limitations on the Broadband Matching of Arbitrary Impedances*, Technial Report No. 41, Massachusetts Institute of Technology, (Jun. 1947).

Thomas R. Cuthbert, Jr., Broadband Impedance Matching—Fast and Simple, *RF Matching Networks*, Nov. 1994, pp. 38–50.

(List continued on next page.)

*Primary Examiner*—Donald Hajec
*Assistant Examiner*—Daniel St. Cyr
*Attorney, Agent, or Firm*—Myers Bigel Sibley & Sajovec

[57] ABSTRACT

Physically small quadrifilar helix antenna systems capable of providing a positive gain, quasi-hemispherical antenna pattern over a relatively broadband frequency range in the L-Band frequency band. The antenna systems according to the present invention generally comprise a quadrifilar helix antenna and at least one antenna feed network, and may further comprise matching means for improving the broadband frequency performance of the antenna. In a preferred embodiment, the elements of the quadrifilar helix antenna which form each bifilar helix are short-circuited at their distal ends, and energy is fed to and induced from the antenna via receive and transmit 90° hybrid couplers which are electrically connected to the bifilar loops of the quadrifilar helix antenna. The antenna systems may further include first and second circuit branches for changing the resonant frequency of the antenna to first and second resonant frequencies corresponding to separate transmit and receive frequency bands, and switches or other disconnection means which are used to electrically isolate the first circuit branch from the antenna during periods when the antenna is receiving a signal and to electrically isolate the second circuit branch from the antenna during periods of transmission.

45 Claims, 4 Drawing Sheets

U.S. PATENT DOCUMENTS

| | | | |
|---|---|---|---|
| 5,489,916 | 2/1996 | Waterman et al. | 343/895 |
| 5,572,172 | 11/1996 | Standke et al. | 333/128 |
| 5,572,227 | 11/1996 | Pal et al. | 343/767 |
| 5,581,268 | 12/1996 | Hirshfield | 343/853 |
| 5,587,719 | 12/1996 | Steffy | 343/895 |
| 5,594,461 | 1/1997 | O'Neill, Jr. | 343/895 |
| 5,706,019 | 1/1998 | Darden, VI et al. | 343/895 |
| 5,754,143 | 5/1998 | Warnagiris et al. | 343/895 |

OTHER PUBLICATIONS

William E. Sabin, Broadband HF Antenna Matching with ARRL Radio Designer, *QST*, Aug. 1995, pp. 33–36.

Maximising Monopole Bandwidth, *Electronics World & Wireless World*, Dec. 1994.

Robert J. Dehoney, Program Synthesis Antenna Matching Networks for Maximum Bandwidth, *QST*, May, 1995.

Mikael Öhgren, Resonant Kvadrilär Helixantenn för Mobilkommunikation via Satellit, *Saab Ericsson Space*, Docunment No. SE/REP/0220/A, Jan. 5, 1996.

C.C. Kilgus, Resonant Quadrifilar Helix Design, *The Microwave Journal*, Dec. 1970, pp. 49–54.

Arlon T. Andrews, et al., The Ouadrifilar Helix Antenna, *IEEE Transactions of Antennas and Propogation*, vol. AP–22, No. 2, Mar. 1974, pp. 173–178.

S.A. Schelkunoff, A General Radiation Formula, *Proceedings of the I.R.E.*, Oct., 1939, pp. 660–666.

C.C. Kilgus, Multielement, Fractional Turn Helices, *IEEE Transactions on Antennas and Propation*, Jul., 1968.

C.C. Kilgus, Resonant Quadrifilar Helix, *IEEE Transaction on Antennas and Propogation*, May, 1969.

Kraus, *Antennas*, Sections 7–18 and 7–19, pp. 332–339.

L-BAND QUADRIFILAR HELIX ANTENNA

FIELD OF THE INVENTION

The present invention relates generally to antenna systems for user terminal handsets. More particularly, the present invention relates to quadrifilar helix antenna systems for use with mobile telephone user handsets.

BACKGROUND OF THE INVENTION

Cellular and satellite communication systems are well known in the art for providing communications links between mobile telephone users and stationary users or other mobile users. These communications links may carry a variety of different types of information, including voice, data, video and facsimile transmissions. In typical cellular systems, wireless transmissions from mobile users are received by local, terrestrial based, transmitter/receiver stations. These local base stations or "cells" then retransmit the mobile user signals, via either the local telephone system or the cellular system, for reception by the intended receive terminals.

Many cellular systems rely primarily or exclusively on line-of-sight communications. In these systems, each local transmitter/receiver has a limited range, and consequently, a large number of local cells may be required to provide communications coverage for a large geographic area. The cost associated with providing such a large number of cells may prohibit the use of cellular systems in sparsely populated regions and/or areas where there is limited demand for cellular service. Moreover, even in areas where cellular service is not precluded by economic considerations, "black-out" areas often arise in terrestrial based cellular systems due to local terrain and weather conditions.

As such, it has been proposed to provide a combined cellular/satellite communications network that integrates a limited terrestrial based cellular network with a satellite communications network to provide communications for mobile users over a large geographical area where it may be impractical to provide cellular service. In the proposed system, terrestrial based cellular stations would be provided in high traffic areas, while an L-Band satellite communications network would provide service to remaining areas. In order to provide both cellular and satellite communications, the user terminal handsets used with this system would include both a satellite and a cellular transceiver. Such a combined system could provide full communications coverage over a wide geographic area without requiring an excessive number of terrestrial cells.

In this proposed system, which is known as the Asian Cellular Satellite System, the satellite network would be implemented as one or more geosynchronous satellites orbiting approximately 22,600 miles above the equator. These satellites could provide spot beam coverage over much of the far east, including China, Japan, Indonesia and the Philippines. In this system, signals transmitted to the satellite will fall within the 1626.5 MHz to 1660.5 MHz transmit frequency band, and the signals transmitted from the satellite will fall within the 1525 MHz to 1559 MHz receive frequency band.

While integrating satellite and cellular service together in a dual-mode system may overcome many of the disadvantages associated with exclusively terrestrial based cellular systems, providing dual-mode user terminal handsets that meet consumer expectations regarding size, weight, cost, ease of use and communications clarity is a significant challenge. Consumer expectations relating to such physical characteristics and communications performance of handheld mobile phones have been defined by the phones used with conventional cellular systems, which only include a single transceiver that communicates with a cellular node which typically is located less than 20 miles from the mobile user terminal. By way of contrast, the handheld user terminals which will be used with the Asian Cellular Satellite System must include both a cellular and a satellite transceiver. Moreover, the large free space loss associated with the satellite communications aspect of the system may significantly increase the power and antenna gain which must be provided by the antenna for the satellite transceiver on the user terminal handset, as the signals transmitted to or from the satellites undergo a high degree of attenuation in traveling the 25,000 or more miles that typically separates the user handset from the geosynchronous satellites.

Furthermore, the satellite aspects of the network also may impose additional constraints on the user terminal handsets. For instance, the satellite transceiver provided with the user terminal handset preferably should provide a quasi-hemispherical antenna radiation pattern, in order to avoid the need to track a desired satellite. Additionally, the antenna which provides this quasi-hemispherical radiation pattern should transmit and receive a circularly polarized waveform, so as both to minimize the signal loss resulting from the arbitrary orientation of the satellite antenna on the user terminal with respect to the satellite and to avoid the effects of Faraday rotation which may result when the signal passes through the ionosphere. Moreover, the satellite antenna on the handheld transceiver should also have a low front-to-back ratio and low gain at small elevation angles in order to provide a low radiation pattern noise temperature.

In addition to the above constraints, it is also preferable that the handset satellite transceiver be capable of operating over the full extent of the transmit and receive frequency bands associated with the satellite network. The operating frequency band of the Asian Cellular Satellite System, however, is as large as any communications bandwidth associated with user terminal antenna systems employed in various prior art L-Band satellite communications systems. Moreover, as discussed above, the satellite network transmits signals in one frequency band (the transmit frequency subband) and receives signals in a separate frequency band (the receive frequency subband) in order to minimize interference between the transmit and receive signals. Thus the satellite transceiver on the user handset preferably provides an acceptable radiation pattern across both the transmit and receive frequency subbands.

In light of the above constraints, there is a need for handheld satellite transceivers, and more specifically, antenna systems for such transceivers, capable of transmitting and receiving circularly polarized waveforms which provide a relatively high gain quasi-hemispherical radiation pattern over separate, relatively broadband, transmit and receive frequency subbands. Such an antenna system preferably would be capable of receiving signals from, or transmitting signals to, satellites which may be located anywhere in the hemisphere. Moreover, given the handheld nature of the user terminals and consumer expectations of an antenna which is conveniently small for ease of portability, the satellite antenna system capable of meeting the aforementioned requirements should fit within an extremely small physical volume. These user imposed size constraints may also place limitations on the physical volume required by the antenna feed structure and any matching, switching or other networks required for proper antenna operation. Thus, for instance, in the Asian Cellular Satellite System, the satellite network link budgets require the satellite antenna system on the handheld phone to be capable of providing a net gain of at least 2 dBi over all elevation angles exceeding 45°, where the net gain is defined as the actual gain or "directivity" provided by the antenna minus matching, absorption or other losses incurred in the antenna feed structure. Additionally, the antenna must also have an axial ratio of less than 3 dB while providing good front to back ratio over the entire receive frequency subband. These performance characteristics must be provided by an antenna which, along with any associated impedance matching circuits or other components, fits within a cylinder 13 centimeters in length and 13 millimeters in diameter.

Helix antennas, and in particular, multifilar helix antennas, are relatively small antennas that are well suited for various applications requiring circularly polarized waveforms and a quasi-hemispherical beam pattern. A helix antenna is a conducting wire wound in the form of a screw thread to form a helix. Such helix antennas are typically fed by a coaxial cable transmission line which is connected at the base of the helix. A multifilar helix antenna is a helix antenna which includes more than one radiating element. Each element of such a multifilar helix antenna is generally fed with an equal amplitude signal that is separated in phase by 360°/N, where N is the number of radiating antenna elements. As the phase separation between adjacent elements varies from 360°/N, the antenna pattern provided by the multifilar helix antenna tends to degrade significantly. Accordingly, the feed structure which couples the signals between the elements of a multifilar helix antenna and the transmitter/receiver preferably introduces minimal or no phase distortions so that such degradation of the antenna pattern is minimized or prevented.

A common type of multifilar helix antenna is the quadrifilar helix. The quadrifilar helix antenna is a circularly polarized antenna which includes four orthogonal radiating elements arranged in a helical pattern (which may be fractional turn), which are excited in phase quadrature (i.e., the radiated energy induced into or from the individual radiating elements is offset by 90° between adjacent radiating elements).

Quadrifilar helix antennas can be operated in several modes, including axial mode, normal mode or a proportional combination of both modes. To achieve axial mode operation, the axial length of each antenna element is typically several times larger than the wavelength corresponding to the center frequency of the frequency band over which the antenna is to operate. Operated in this mode, a quadrifilar helix antenna can provide a relatively high gain radiation pattern. However, such a radiation pattern is highly directional (i.e., it is not quasi-hemispherical) and hence axial mode operation is typically not appropriate for satellite communications terminals that do not include means for tracking the satellite.

Operated in the normal mode, each helix of a quadrifilar helix antenna is typically balun fed at the top, and the helical arms are typically of resonant length (i.e., $\frac{1}{4}\lambda$, $\frac{1}{2}\lambda$, $\frac{3}{4}\lambda$ or $\lambda$ in length, where $\lambda$ is the wavelength corresponding to the center frequency of the frequency band over which the antenna is to operate). These elements are wound on a small diameter with a large pitch angle. In this mode, the antenna typically provides the quasi-hemispherical radiation pattern necessary for mobile satellite communications, but unfortunately, the antenna only provides this gain over a relatively narrow bandwidth situated about the resonant frequency. Moreover, the natural bandwidth of the antenna is proportional to the diameter of the cylinder defined by the quadrifilar helix antenna, and thus, all else being equal, the smaller the antenna the smaller the operating bandwidth. As discussed above, certain emerging cellular and satellite phone applications have relatively large transmit and receive operating bandwidths. These bandwidths may approach or even exceed the bandwidth provided by quadrifilar helix antennas operated in normal mode, and this is particularly true where other system requirements significantly restrict the maximum diameter of the antenna.

In addition to the above-mentioned bandwidth limitations associated with quadrifilar helix antennas, the bandwidth over which these antennas may effectively operate may also be limited by power transfer considerations. Specifically, in operation, it is necessary to transfer electrical signals between a transmitter/receiver and the quadrifilar helix antenna. However, such power transfer typically is not lossless due to reflections which arise as a result of imperfect impedance matching between the source and the load. If large enough, the reflected power loss, which may be expressed in terms of voltage standing wave ratio ("VSWR"), may prevent the communications system from meeting its link budgets. By way of example, for the Asian Cellular Satellite System, system link budgets require that the voltage standing wave ratio, as measured at the output of the handset transmitter/receiver, be less than 1.5.

While it often is possible to match the input impedance of the quadrifilar helix antenna to the impedance of the interconnecting transmission line(s) from the transmitter/receiver, such a match will only occur over a small frequency range as the input impedance of a quadrifilar helix antenna varies significantly with frequency. Accordingly, even if a perfect match (i.e., VSWR=1.0) is not required, an acceptable match will typically still only be achievable over some finite bandwidth. This bandwidth may be less than the operating bandwidth required by emerging cellular and satellite phone applications. As such, impedance mismatches may also serve to limit the effective bandwidth of quadrifilar helix antenna systems.

Quadrifilar antennas have previously been used in a number of mobile L-Band satellite communication applications, including INMARSAT, NAVSTAR, and GPS. However, nearly all these prior art antennas were physically much too large to satisfy the size requirements of emerging satellite phone applications. Moreover, these prior art antennas also generally do not meet the size constraints imposed by these emerging applications while also providing the gain, axial ratio, noise temperature, front-to-back ratio and broadband performance that are required by these emerging applications. Accordingly, a need exists for a new, significantly smaller, satellite phone antenna system that is capable of providing a quasi-hemispherical antenna pattern with positive gain over widely separated, relatively broadband, transmit and receive frequency subbands.

SUMMARY OF THE INVENTION

In view of the above limitations associated with existing antenna systems, it is an object of the present invention to provide physically small quadrifilar helix antenna systems for L-Band satellite and cellular phone networks.

Another object of the present invention is to provide L-Band quadrifilar helix antenna systems capable of providing a radiation pattern with a directivity exceeding 3 dBi over all elevation angles exceeding 45°.

A third object of the present invention is to provide L-Band quadrifilar helix antenna systems capable of providing a good impedance match over a broad band of operating frequencies.

These and other objects of the present invention are provided by physically small L-Band quadrifilar helix antenna systems for handheld user transceivers that capitalize on the size, gain, polarization, and radiation pattern characteristics achievable with quadrifilar helix antennas, while avoiding the bandwidth limitations of such antennas. These improved performance characteristics are provided through the use of a small diameter closed loop antenna design and an impedance matching network which increases the operating bandwidth of the antenna.

In one embodiment of the present invention, a handheld transceiver for transmitting and receiving radio signals is provided that includes a transmitter, a receiver, a user interface, a quadrifilar helix antenna and coupling means, which electrically connect the antenna to the user terminal transceiver. In this embodiment, the axial length of the elements forming the quadrifilar helix antenna are preferably in the range of 7–9 centimeters and the diameter of the cylinder defined by these elements is preferably between 6 and 13 millimeters. In another embodiment, this transceiver transmits signals in the 1626.5 MHz to 1660.5 MHz frequency band and receives signals in the 1525 MHz to 1559 MHz frequency band. The quadrifilar helix antenna may comprise two bifilar helices arranged orthogonally and excited in phase quadrature, and the antenna may be provided as a stand alone device separate from the handheld user transceiver.

In another embodiment of the present invention, the quadrifilar helix antenna comprises four antenna elements which each have an origin and a distal end. In this embodiment, the origin of the first and third antenna elements are coupled to the transceiver, and the origin of the second and fourth antenna elements are coupled to a first reference voltage. The first and second antenna elements and the third and fourth antenna elements are electrically connected at their distal ends. Each of these filar helices may comprise a helix with a pitch angle from about 55 to 85 degrees.

In a further embodiment of the present invention, the length of each antenna element is approximately 0.5 the wavelength ($\lambda$) of operation of the quadrifilar helix antenna, and the elements of the antenna define a cylinder with a constant diameter which is less than 10% the wavelength ($\lambda$) of operation of the antenna. The quadrifilar helix antenna may further be configured to transmit and receive circularly polarized signals.

In another aspect of the present invention, matching means are coupled to the elements of the quadrifilar helix antenna for increasing the operating bandwidth of the quadrifilar helix antenna. Preferably these matching means reduce the voltage standing wave ratio as measured at the output of the transceiver to less than 1.5 for a continuous bandwidth of at least 25 MHz in the L-Band frequency band. These matching means may comprise reactive elements coupled to the elements of the quadrifilar helix antenna. The antenna system may also include one or more flexible microelectronic substrates on which the quadrifilar helix antenna may be implemented and on which the matching means may be implemented as lumped element devices.

In another embodiment of the present invention, a quadrifilar helix antenna system is provided wherein the axial length of each element of the quadrifilar helix antenna is between 0.37 and 0.48 the wavelength corresponding to the frequency range over which the antenna is designed to transmit and receive signals, and the diameter of the cylinder defined by the antenna is between 0.03 and 0.07 this wavelength. These and other embodiments of the quadrifilar helix antenna systems of the present invention provide the gain, bandwidth, polarization, and radiation pattern characteristics necessary for emerging mobile satellite communications applications in a physical package which is conveniently small and meets consumer expectations relating to ease of portability.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Additionally, while the antenna systems of the present invention are particularly advantageous for use in certain satellite communications applications, it will be understood by those of skill in the art that these antenna systems may be advantageously used in a variety of applications, including cellular, terrestrial based communications systems, and thus the present invention should not be construed as limited in any way to antenna systems for use with satellite communication terminal handsets. Like numbers refer to like elements throughout.

Figure 1:
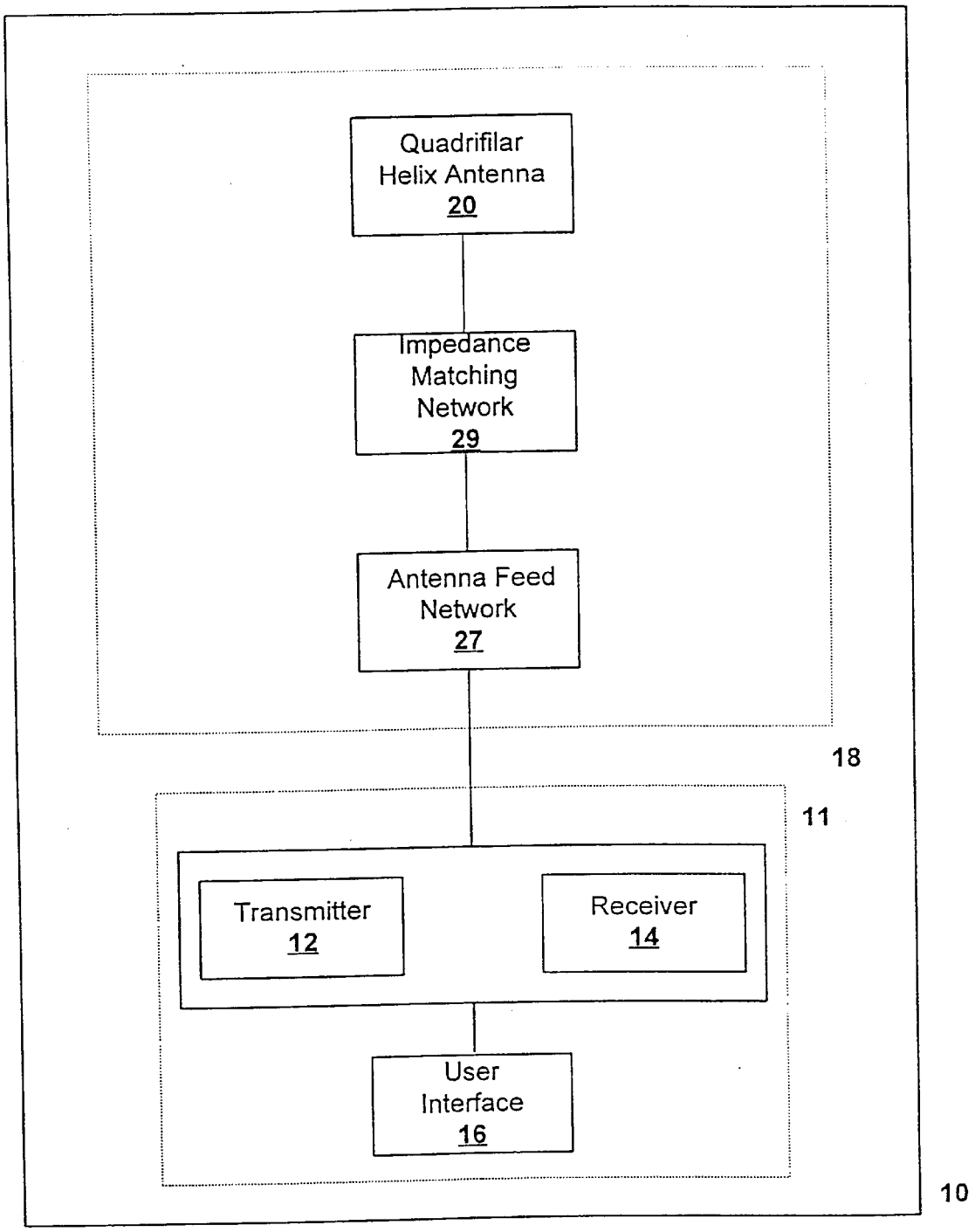
FIG. 1 is a block diagram of a quadrifilar helix antenna system according to the present invention.

An embodiment of a handheld wireless communications terminal 10 according to the present invention is depicted in the block diagram of FIG. 1. Terminal 10 generally comprises an antenna system 18, a transceiver 11 which comprises a transmitter 12, a receiver 14, and a user interface 16. User interfaces 16 suitable for use in handheld radio communications terminals are well known to those of skill in the art, such as microphones, keypads, rotary dials and the like. Similarly, a wide variety of transmitters 12 and receivers 14 which are suitable for use with a handheld radio communications terminal are also known to those of skill in the art.

As depicted in FIG. 1, the antenna system 18 according to the present invention employs a quadrifilar helix antenna 20. This antenna 20 may be electrically connected to impedance matching network 29, which is used to improve the broadband impedance match between antenna system 18 and transceiver 11. Impedance matching network 29 is coupled to antenna feed network 27. The feed network 27 divides and phase rotates signals from transmitter 12 for radiation by the individual elements of quadrifilar helix antenna 20 during periods of transmission, and combines and delivers to receiver 14 radiated energy received by antenna 20 when communications terminal 10 operates in receive mode.

Figure 2:
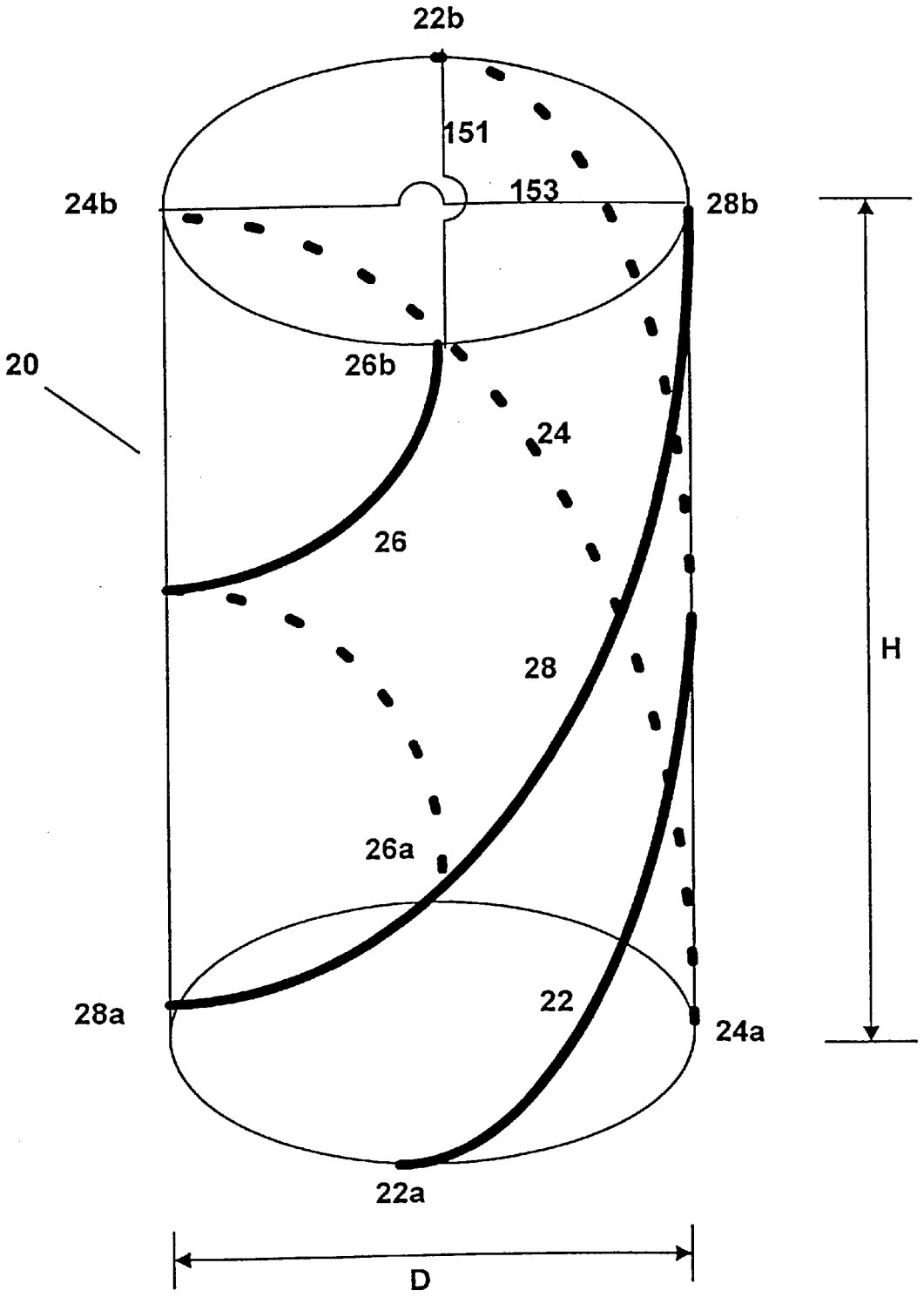
FIG. 2 is a perspective view of a quadrifilar helix antenna according to the present invention.

As illustrated in FIG. 2, quadrifilar helix antenna 20 is comprised of four radiating helical antenna elements 22, 24, 26, 28 or "filars." A filar is typically implemented as a wire or strip, such as 22, wrapped in a helical shape along the length of a coaxial supporting tube. Thus, antenna 20 comprises a pair of bifilar helices, 22, 26 and 24, 28. Preferably, elements 22, 24, 26, 28 of quadrifilar helix 20 antenna are physically spaced from each other by 90° and are excited in phase quadrature. Moreover, where the elements are implemented as a strip of conducting material, preferably relatively wide strips (e.g., on the order of 3–5 millimeters wide for an antenna designed to operate in the 1500–1660 MHz frequency range) are used to reduce the loss and to minimize the inductance of the elements, thereby facilitating matching the impedance of antenna 20 to the impedance of transmitter 12 and receiver 14.

Alternative embodiments within the scope of the present invention include a quadrifilar helix antenna 20 having radiating elements 22, 24, 26, 28 which are helical in the sense that they each form a coil or part coil around an axis, but also change in diameter from one end to the other. Thus, while the preferred embodiment of the antenna 20 has helical elements defining a cylindrical envelope, it is possible to implement antenna 20 to have elements defining instead a conical envelope or another surface of revolution. Moreover, note that as used herein, it is intended that the word "helix" not imply a plurality of turns. In particular, a "helix" as used herein may constitute less than one full turn.

As is illustrated in FIG. 2, a quadrifilar helix antenna may be defined by (i) the axial length (H) of the four radiating elements, (ii) the diameter (D) of the cylinder defined by these elements and the cross arms associated with the connections at the origin and distal ends and (iii) the actual length (L) of each radiating element. In a preferred embodiment of the present invention, the diameter D of the cylinder defined by the elements of L-Band quadrifilar helix antenna 20 is between 6 and 13 millimeters, to provide a conveniently small antenna structure which meets consumer expectations for small, easily portable cellular phones. Alternatively, diameter D of the cylinder defined by the elements of antenna 20 may preferably be between approximately 0.03 and 0.07 the wavelength ($\lambda$) which corresponds to the center frequency of the frequency band over which the antenna is to receive and transmit signals.

Similarly, antenna elements 22, 24, 26, 28 are preferrably of an axial length (i.e., the height of the cylinder defined by the antenna elements) between 7 and 9 centimeters so as to provide a conveniently small antenna for the portable cellular/satellite phone. Alternatively, the axial length of elements 22, 24, 26, 28 may preferably be between approximately 0.37 and 0.48 the wavelength ($\lambda$) which corresponds to the center frequency of the frequency band over which the antenna is to receive and transmit signals. Additionally, the length of each antenna element is preferably of such a length so as to facilitate operating the antenna in resonant mode over the frequency band of interest. Those of skill in the art will understand that quadrifilar helix antennas may be designed to operate at resonance with element lengths of $\lambda/4$, $\lambda/2$, 3 $\lambda/4$ or $\lambda$, where $\lambda$ is the wavelength corresponding to the center frequency of the frequency band over which the antenna is to receive and transmit signals. However, as will also be understood by those of skill in the art, the actual physical length of the antenna elements may be appreciably shortened due to radome effects, as the radome tends to change the velocity of propagation such that the length is shorter than in free space. Such an effect is advantageous where smaller size is an important goal, and thus it will be understood that the quadrifilar helix antenna systems of the present invention may also be operated at or near resonance with antenna elements of physical lengths other than quarter-wavelength multiples.

Moreover, while quadrifilar helix antennas with elements of actual or electrical (where radome effects apply) length $\lambda/4$, $\lambda/2$, $3\lambda/4$ and $\lambda$ are known to operate at resonance, such resonant or near resonant operation may also be obtained with elements of other lengths. Resonant operation implies that the equivalent reactance is zero while the equivalent immittance is a real value. Operation at resonance is desirable, because at resonance maximum power transfer may be accomplished without any further reactive matching. However, as will be understood by those of skill in the art, through the use of additional matching means it is possible to design a quadrifilar helix antenna with element lengths which are not a multiple of a quarter wavelength that operates at or near resonance, thereby providing for good power transfer between the source and the load. Accordingly, it should be recognized that the present invention is not limited to quadrifilar helix antennas with element lengths which are multiples of a quarter wavelength, but instead encompasses quadrifilar helix antennas with any element lengths which, in conjunction with any matching structure, provide for nearly resonant operation.

The radiation pattern provided by quadrifilar helix antenna 20 is primarily a function of the helix diameter, pitch angle (which is a function of the number of turns per unit axial length of the helix) and element lengths. In a preferred embodiment of the present invention, the helical antenna elements 22, 24, 26, 28 are approximately $\lambda/2$ in electrical length. In this embodiment, antenna 20 preferably has a pitch angle from about 55 to 85 degrees. In this preferred range, the lower pitch angles provide more hemispherical coverage, while the higher pitch angle values concentrate the radiation pattern (and hence provides greater directivity) over a smaller solid angle than hemispherical coverage for element lengths on the order of ½ wavelength. Given the specific requirements of the system in which the antenna is to be used, a judicious choice of pitch angle may be made to provide the optimum tradeoff between coverage and directivity.

In the above-described $\lambda/2$ element length embodiment of the present invention, the quadrifilar helix antenna 20 operates in nearly resonant mode, and provides a quasi-hemispherical radiation pattern for a relatively narrow bandwidth about the resonant frequency which corresponds to the wavelength $\lambda$. As discussed above, the directivity provided by such a quadrifilar helix antenna varies with the pitch angle. Thus, for example, quadrifilar helix antenna with elements of axial length on the order of 7 to 9 centimeters and a diameter on the order of 6 to 13 millimeters that has a pitch angle in the range of 65 degrees can provide a radiation pattern in the L-band frequency band with over 6 dBi directivity at zenith and over 4 dBi directivity for all other elevation angles exceeding 45°, other quasi-hemispherical radiation patterns may similarly be obtained by adjusting the pitch angle, with higher pitch angles generally providing broader coverage but lower peak gain. As will be understood by those of skill in the art, the above-mentioned antenna radiation pattern directivity values refer to the actual gain achievable by the antenna, and do not consider any losses which may occur in the antenna feed network 27 or impedance matching network 29. Typically, such losses are on the order of 2 dB, and hence the "net gain" of the above described antenna with a 65° pitch angle would be approximately 4 dBi at Zenith and 2 dBi at all elevation angles exceeding 45°.

As illustrated in FIG. 2, the four individual antenna elements 22, 24, 26, 28 that comprise quadrifilar helix antenna 20 each have an origin 22*a*, 24*a*, 26*a*, 28*a*, which is the end proximate antenna feed network 27, and a distal end 22*b*, 24*b*, 26*b*, 28*b*. As indicated in FIG. 2, the distal ends 22*b*, 26*b* of quadrifilar helix antenna elements 22 and 26 are preferably electrically connected by wire or strip 151 to form a bifilar loop, and the distal ends 24*b*, 28*b* of elements 24 and 28 are similarly electrically connected by wire or strip 153 to form a second bifilar loop. In this embodiment, origins 22*a*, 24*a* of elements 22, 24 are coupled to antenna feed network 27 and origins 26*a*, 28*a* of elements 26, 28 are coupled to ground. This embodiment of the quadrifilar helix antenna 20 is referred to as a closed loop embodiment, as the elements of antenna 20 are electrically connected at their distal ends. These are to be distinguished from open-loop quadrifilar helix antennas, which comprise four helical elements each of which is opencircuited at its distal end.

In a preferred embodiment of antenna 20, bifilar loops 22, 26; 24, 28 are symmetrical. Accordingly, electrical connections 151, 153 are preferably implemented as identically shaped conductive wires or strips arranged so as to provide the short-circuits which form bifilar loops 22, 26; 24, 28 while electrically isolating bifilar loop 22, 26 from bifilar loop 24, 28. Such a symmetrical arrangement of electrical connections 151, 153 minimizes the variation in phase between adjacent elements from the ideal phase offset of 90°.

The closed loop embodiment of quadrifilar helix antenna 20 is advantageous for solving a problem that may arise when open loop quadrifilar helix antennas are used in mobile phone applications. Specifically, in applications which require a small antenna diameter, a bottom-fed open loop ½ wavelength quadrifilar helix antenna has a nearly open circuit impedance (1000 ohms or more) at the resonant frequency. Such an impedance may be too large to transform to the desired impedance, which is often on the order of 50 ohms as the antenna typically is connected to transceiver 11 via one or more 50 ohm impedance coaxial cables, and thus maximum power transfer may not be obtained because the impedance of the antenna cannot be matched to the impedance of the source transmission line. In a preferred embodiment, the resonant resistance of the closed loop bottom-fed $\lambda/2$ length element quadrifilar helix antenna is in the region of 4–8 ohms when antenna 20 operates in receive mode and 8–12 ohms when antenna 20 operates in transmit mode. This may be transformed to the order of 50 ohms to match the impedance of the transmission source by various impedance transformation techniques, such as a radio frequency transformer or via impedance matching network 29. However, for certain element lengths other than ½ wavelength, such as ¾ wavelength elements, the open circuit impedance may be much lower so as to be transformable to the order of 50 ohms.

Quadrifilar helix antennas are known to be capable of radiating right or left hand circularly polarized signals when fed from the top in a backfire mode, fed in the middle via a selectable up or down mode, or when bottom fed in a forward fire reverse twist mode. However, top fed versions may require sleeve baluns in the center of the cylindrical structure, which may be difficult to fabricate. This is particularly true at the microwave frequencies used in some satellite and cellular phone systems due to the small diameter of the helical antenna structure required by such phones. Similarly, center fed quadrifilar helical antennas may also be difficult to fabricate. In a preferred embodiment, this invention solves these fabrication problems by using an origin-fed network to the quadrifilar helix antenna which drives two closed bifilar loops.

The twist of the individual helices 22, 24, 26, 28 may be right hand or left hand, where each element 22, 24, 26, 28 comprising the antenna 20 has the same direction of twist. In the above-mentioned preferred embodiment where antenna 20 is origin fed in endfire mode, by IEEE and industry conventions, a left hand twist is used to receive and transmit right hand circularly polarized waveforms, whereas a right hand twist is used to receive and transmit left hand circularly polarized waveforms.

Quadrifilar helix antenna 20 may include a radome, which typically is implemented as a plastic tube with an end cap. The elements 22, 24, 26, 28 of quadrifilar helix antenna 20 are preferably comprised of a continuous strip of electrically conductive material such as copper. In a preferred embodiment, these radiating elements 22, 24, 26, 28 are printed on a flexible, planar dielectric substrate such as fiberglass, TEFLON, polyimide or the like, and the radiating elements 22, 24, 26, 28 are disposed on the dielectric base via etching, deposition or other conventional methods. This flexible dielectric base is then rolled into a cylindrical shape, thereby converting the linear strips into helical antenna elements 22, 24, 26, 28. However, while the technique of forming a quadrifilar helix antenna described above is a preferred method, it will be readily apparent to those of skill in the art that quadrifilar helix antenna 20 may be implemented in a variety of different ways, and that a cylindrical support structure is not even required.

As indicated in FIG. 1, quadrifilar helix antenna 20 is coupled to impedance matching network 29. Such an impedance matching network 29 is preferred because the system link budgets may require a high efficiency antenna system on the user terminal, in which case it is necessary that antenna 20 present a good source impedance for handset receiver 14 and a good load for handset transmitter 12. Impedance matching network 29 is typically implemented as one or more bandpass networks of reactive components which operate to ensure that the voltage standing wave ratio ("VSWR"), as measured between antenna 20 and transceiver 11, stays below some specified level for the frequency band over which antenna 20 is to operate. These one or more bandpass networks of impedance matching network 29 thereby increase the bandwidth over which antenna 20 can effectively operate. Such impedance matching is possible because in most mobile cellular and satellite phone applications, the radiation pattern associated with antenna 20 generally does not require that the driving point impedance be resonant, but instead only requires that a reasonable conjugate match be provided between antenna system 18 and transmitter 12 or receiver 14. Thus, according to the principles of what has become known as "Fano's Law" and which are generally outlined in R. M. Fano, "Theoretical Limitations on the Broadband Matching of Arbitrary Impedance," J. Franklin Inst., February, 1950, pp. 139–154, impedance matching circuits may be employed to increase the bandwidth over which the impedance of antenna system 18 and transmitter 12 or receiver 14 are matched in the sense that the VSWR is maintained below a specified level.

By way of example, a quadrifilar helix antenna of the dimensions required by the Asian Cellular Satellite System has a near resonant resistance at the center of the transmit and receive frequency bands, but has a very high series equivalent reactance at the low and high ends of each 34 MHz frequency band. As such, the operating bandwidth of such an antenna (which is specified as the bandwidth for which the VSWR at the output of transceiver 11 is less than 1.5) is 1% or less of the carrier frequency, and hence in the Asian Cellular Satellite System, is on the order of 15 MHz or less in both the transmit and receive frequency bands. Accordingly, matching structures may be required if such a quadrifilar helix antenna is to be used with that system.

As will be understood by those of skill in the art, a variety of different matching networks may be employed to provide improved broadband impedance matching. Generally, computer aided design techniques are used to derive an optimum topology for the impedance matching network and to determine component values, as discussed in William Sabin, Broadband HF Antenna Matching with ARRL Radio Designer, QST MAGAZINE, August, 1995, pp. 33–36.

Also illustrated in FIG. 1 is antenna feed network 27 which is provided to phase split the energy for radiation in the transmit mode and for combining the received radiated energy in receive mode. This feed network 27 can be implemented as any of a variety of known networks for feeding a quadrifilar helix antenna, such as the combination of a hybrid coupler and two symmetrizer modules disclosed in U.S. Pat. No. 5,255,005 to Terret et al.

Figure 3:
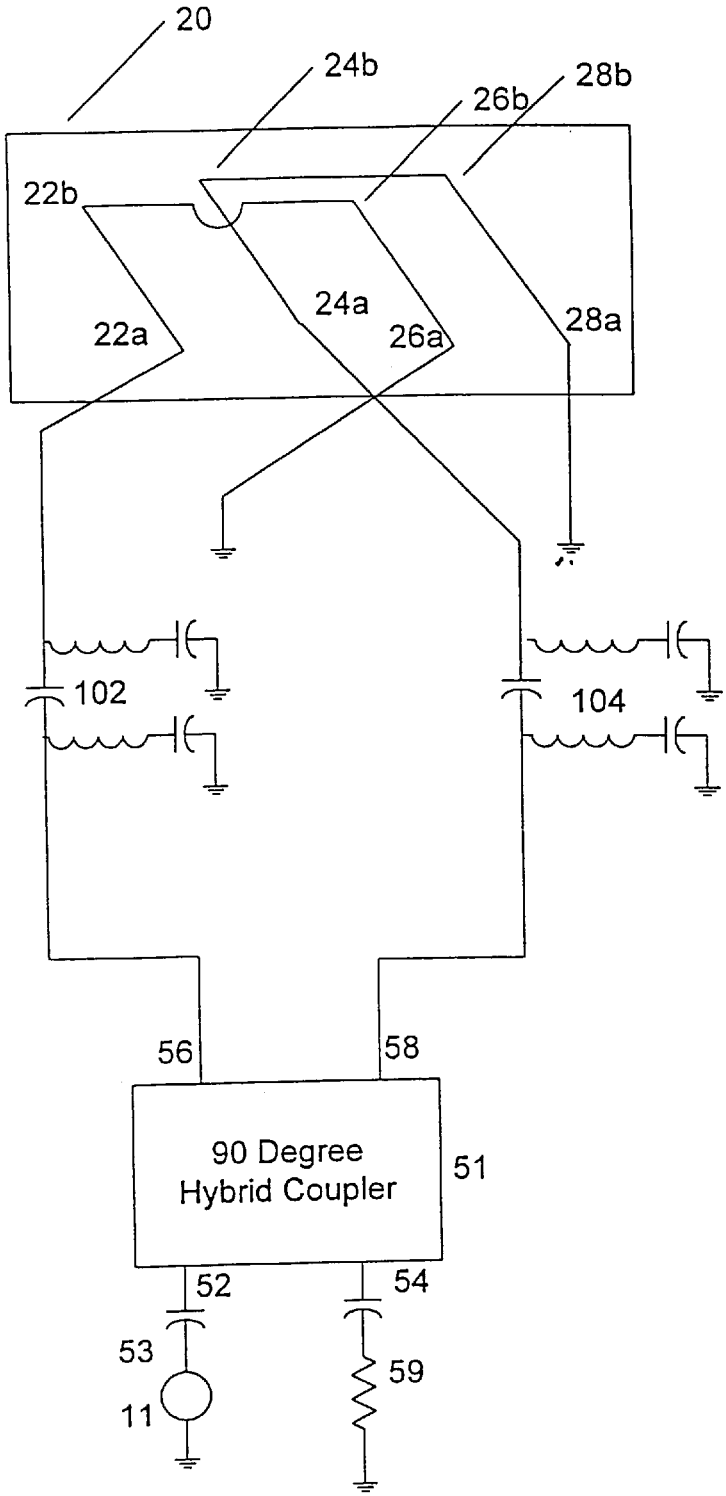
FIG. 3 is a schematic diagram illustrating specific embodiments of an antenna, coupling network and impedance matching network of the present invention.

A preferred embodiment of the quadrifilar helix antenna system 18 of the present invention is illustrated in FIG. 3. In this embodiment, feed network 27 is implemented as a 90° 3 dB splitter/combiner coupler 51. As shown in FIG. 3, 90° hybrid coupler 51 is preferably coupled to the bifilar loops which form quadrifilar helix antenna 20 via impedance matching bandpass networks 102, 104.

As illustrated in FIG. 3, 90° hybrid coupler 51 has inputs 52, 54 and outputs 56, 58. Input 52 is coupled to transceiver 11 through coaxial cable 53 and input 54 is coupled to ground through a resistive termination 59. During periods of transmission, 90° hybrid coupler 51 divides the input source signal from transceiver 11 into two, equal amplitude output signals, which are offset from each other by 90° in phase. The signal fed through output port 56 is coupled to bifilar loop 22, 26 of antenna 20, and the signal fed through output port 58 feeds the second bifilar loop 24, 28.

While 90° hybrid coupler 51 provides a useful means for splitting a source signal for transmission via the dual bifilar loops 22, 26; 24, 28, coupler 51 also facilitates in reducing the effective VSWR seen by transmitter 12 and receiver 14, thereby both improving the link margin and increasing the operating bandwidth over which the antenna may be used. This occurs because 90° hybrid 51 combines the energy incident at the 0° and 90° ports in such a way as to present the desired signal at the input port 52 of coupler 51 while absorbing the reflected signals in the resistive termination 59. Accordingly, the VSWR measured at the transmitter 12 and receiver 14 is only a very minimal portion of the VSWR measured at the ports 56, 58 of 90° hybrid coupler 51 proximate antenna 20.

As will be readily understood by those of skill in the art, 90° hybrid coupler 51 can be implemented in a variety of different ways, such as via distributed quarter-wavelength length transmission lines or as a lumped element device. In a preferred embodiment, coupler 51 is implemented as a lumped element 90° hybrid splitter-combiner which is mounted on a stripline or microstrip electronic substrate. Such a device may be preferred as it can maintain a phase difference of almost exactly 90° between its respective output ports. Distributed quarter wavelength branch line couplers or other arrangements utilizing transmission lines, on the other hand, only maintain a 90° phase difference between the output ports at frequencies near resonance. Thus, for example, given a 34 MHz transmit or receive frequency band in the L-Band frequency range, distributed branch line couplers may result in as much as 4° in phase offset between signals at the center versus signals at the upper and lower ends of the 34 MHz frequency band.

FIG. 3 also illustrates a preferred method of electrically coupling quadrifilar helix antenna 20 to antenna feed network 27. As discussed above, quadrifilar helix antenna 20 may be implemented as a pair of wavelength (λ) long, electrically connected, bifilar loops. As shown in FIG. 3, antenna 20 is fed by coupling λ long loop 22, 26 to the 0° output 56 of 90° hybrid coupler 51 and coupling the second bifilar loop 24, 28 to the 90° output 58. The opposite end of each bifilar loop 26*a*, 28*a* are coupled to electrical ground. In this manner, each element 22, 24, 26, 28 of quadrifilar helix antenna 20, is excited in phase quadrature by equal amplitude signals, as a signal incident at the origin 22*a*, 24*a* of either of the λ long bifilar loops 22, 26; 24, 28 undergoes a 180° phase change in traversing the length of the loop to the respective terminations 26*a*, 28*a*.

Also illustrated in FIG. 3 is a preferred embodiment of impedance matching network 29, which comprises bandpass circuits 102, 104. As shown in FIG. 3, circuits 102, 104 may be implemented as bandpass ladder networks that use a series inductor and capacitor in each shunt leg. Such an arrangement is preferred as the value of the inductors included in circuits 102, 104 which optimize the broadband performance of antenna 20 may be sufficiently small such that low-cost off-the-shelf-components are not available which will guarantee an inductance in the desired range. However, since the impedance across the branch of a network consisting of a series inductor and capacitor is the sum of the positive reactance of the inductor and the negative reactance of the capacitor, bandpass networks 102, 104 in this preferred embodiment allow the use of low-cost, off-the-shelf, larger value inductors which are effectively reduced by the series capacitance. By way of example, if a reactance of +J10 is desired at 1.6 GHz, a one nanohenry coil would be required, but a one nanohenry coil may be prohibitively expensive for some applications. However, the same effect can be accomplished by using a cheaper, off-the-shelf three nanohenry coil providing +J30 ohms reactance in series with a capacitor of –J20 ohms reactance of (about 5 picofarads).

As discussed earlier, the frequency range for which a small diameter (diameter<10 millimeters) resonant quadrifilar helix antenna with antenna elements of λ/2 length has a VSWR<1.5 is approximately 1% of the carrier frequency. Thus, at 1500 MHz, the natural bandwidth of such a quadrifilar helix antenna is on the order of 15 MHz of less. However, through the use of impedance matching networks 102, 104, this bandwidth for which the VSWR<1.5 may easily be increased to 25 MHz (1.7% of the carrier frequency), and with a fairly well optimized impedance matching network may achieve 35 MHz (2.3% of the carrier frequency) or more. Thus impedance matching means 29 can easily double the frequency range over which small diameter quadrifilar helix antennas may operate in the L-Band frequency range.

While the ladder network implementation depicted in FIG. 3 is preferred in various applications, those of skill in the art will understand that a wide variety of impedance matching networks may be used to improve the broadband performance of antenna system 18, and thus the present invention is not limited to the ladder networks depicted in FIG. 3, as other implementations may be used to provide impedance matching circuits 102, 104.

Figure 4:
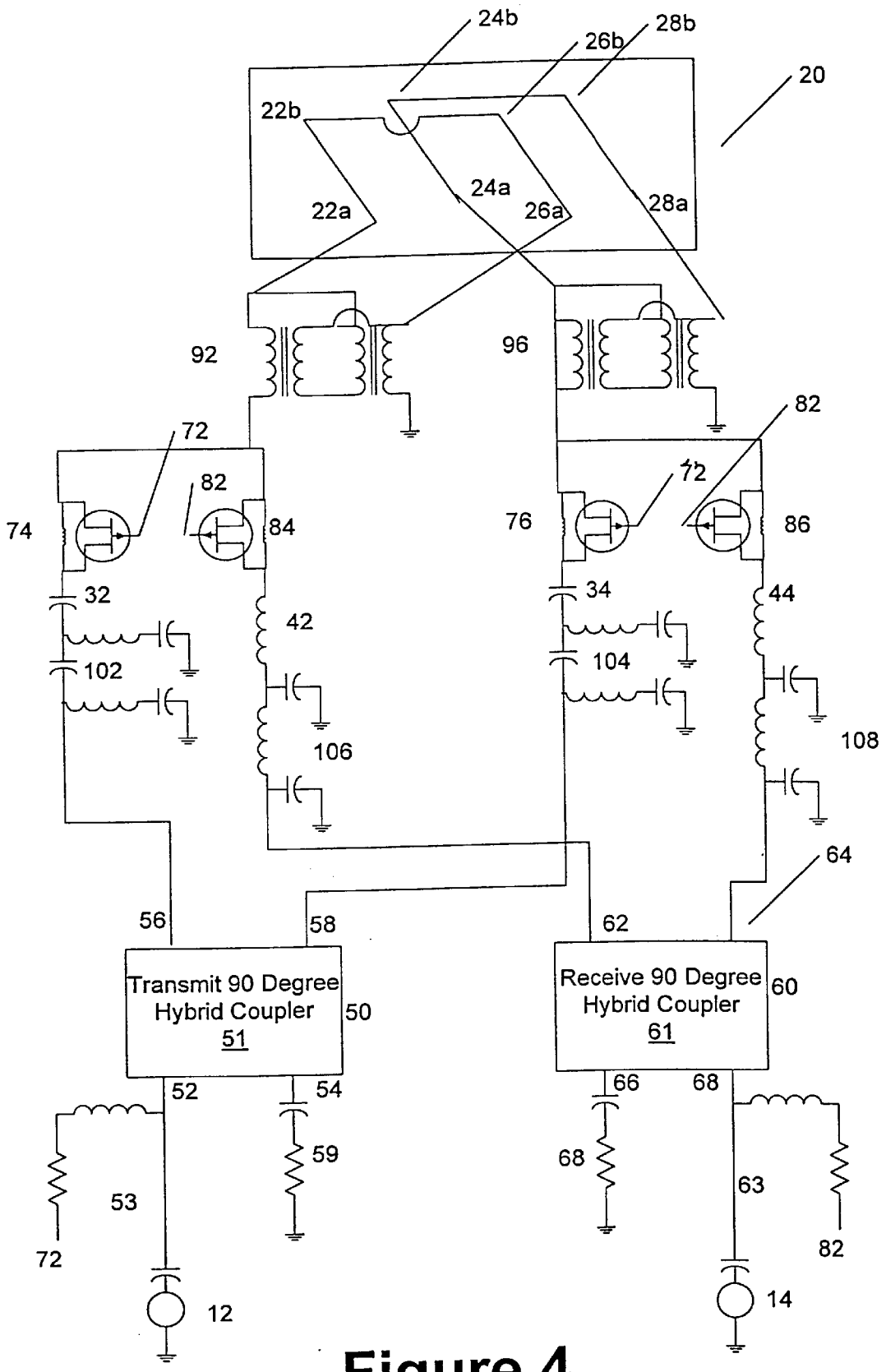
FIG. 4 is a schematic diagram illustrating an alternative embodiment of the present invention.

An alternative embodiment of the present invention, which is designed to facilitate operation of antenna 20 across separate transmit and receive frequency subbands, is depicted in FIG. 4. As indicated in FIG. 4, this alternative embodiment includes first and second circuit branches 32, 34; 42, 44, separate transmit and receive antenna feed networks 51, 61, transmit and receive circuit disconnect means 74, 76; 84, 86, and impedance transformation means 92, 96 in addition to the components described above and depicted in FIG. 3. These additional components provide for dual band operation of quadrifilar helix antenna 20 as follows.

First and second circuit branches 32, 34; 42, 44 are used to adjust the resonant frequency of quadrifilar helix antenna 20 to allow the antenna 20 to resonate at a minimum of two separate frequencies. Specifically, first circuit branch 32, 34 may be used to change the resonant frequency of antenna 20 to correspond to approximately the center frequency of a transmit frequency subband, while second circuit branch 42, 44 similarly may be used to change the resonant frequency of antenna 20 to correspond to approximately the center frequency of a receive frequency subband. In a preferred embodiment of the present invention, quadrifilar helix antenna 20 is designed to resonate at a frequency somewhere between the transmit and receive frequency subbands. First and second circuit branches 32, 34; 42, 44 are then used to tune the antenna to the center frequencies of the separate transmit and receive frequency subbands. Thus, by providing separate transmit and receive circuit branches 32, 34; 42, 44 which effectively change the resonant frequency of quadrifilar helix antenna 20, even a narrowband quadrifilar helix antenna 20 can be made to operate at separated transmit and receive frequency subbands.

As illustrated in FIG. 4, first and second circuit branches 32, 34; 42, 44 may be implemented as reactive elements which are coupled to the elements 22, 24, 26, 28 of quadrifilar helix antenna 20 to thereby change the effective electrical length of these antenna elements. By way of background, an equivalent circuit of a closed loop element pair within a quadrifilar helix antenna can be formed by a series resistor, inductor and capacitor with a shunt capacitance across the series resistor, inductor and capacitor. Accordingly, the resonant frequency of each element is the resonant frequency associated with the equivalent series resistor-inductor-capacitor network, where the shunt capacitance causes the equivalent series reactance to be lower in the lower frequency band and higher in the higher frequency band. Thus, by placing an additional reactive component (e.g., another capacitor or inductor) in series in a circuit branch coupled to one of these antenna elements, the resonant frequency of the element may be effectively changed to a different frequency.

In the preferred embodiment of the present invention depicted in FIG. 4, the first circuit branch is implemented as capacitors 32, 34 which are electrically connected between output 56 of transmit 90° hybrid coupler 51 and bifilar loop 22, 26 and output 58 and bifilar loop 24, 28, respectively. These capacitors 32, 34 effectively shorten the electrical length of bifilar loops 22, 26; 24, 28 and thus tune antenna 20 to a higher resonant frequency. Similarly, the second circuit branch is implemented as inductors 42, 44 which are electrically connected between bifilar loops 22, 26; 24, 28 and the respective inputs 62, 64 to receive 90° hybrid coupler 61. These inductors 42, 44 effectively lengthen the electrical length of antenna elements 22, 24, 26, 28 and thus tune antenna 20 to a lower resonant frequency.

However, as will be understood by those of skill in the art, the first and second circuit branches need not be implemented as a pair of capacitors 32, 34 or inductors 42, 44, but instead may be implemented as any combination of reactive elements that effectively change the electrical length of antenna elements 22, 24, 26, 28. Accordingly, various combinations of capacitors and inductors which are electrically coupled between the transmit and receive antenna feed networks 51, 61 and the elements of quadrifilar helix antenna 20 may be used to implement first and second circuit branches 32, 34; 42, 44.

As illustrated in FIG. 4, first and second circuit branches 32, 34; 42, 44 operate in conjunction with transmit and receive circuit disconnect means 74, 76; 84, 86. Specifically, transmit disconnect means 74, 76 operates to electrically isolate the transmit network 32, 34, 51, 12 from antenna 20 when the handset 10 is operating in receive mode, while receive circuit disconnect 84, 86 similarly operates to electrically isolate the receive network 42, 44, 61, 14 from antenna 20 during periods of transmission. Use of switches 74, 76; 84, 86 is preferred because reactive elements 32, 34; 42, 44 may not provide sufficient isolation between the transmit and receive circuit branches in some cellular and satellite phone applications where system link budgets allow for very little coupling loss between the user terminal antenna system 18 and transceiver 11.

Transmit and receive circuit disconnect means 74, 76; 84, 86 help prevent undesired coupling by electrically isolating the "OFF" circuit branch by providing an open-circuit between the antenna 20 and the "OFF" circuit branch (note that the "OFF" circuit branch refers to the transmit circuit branch when the user terminal is operating in receive mode, and refers to the receive circuit branch when the terminal is operating in transmit mode). When such an open-circuit is provided, the "ON" circuit branch essentially operates as if the "OFF" circuit branch was not present. As illustrated in FIG. 4, these disconnect means may be implemented as switching means 74, 76; 84, 86 which are coupled to the bifilar loops 22, 26; 24, 28 of quadrifilar helix antenna 20. Switches 74, 76 are opened by bias signal 72 to provide an open circuit at the origins 22*a*, 26*a* of the bifilar loops when the user terminal 10 is in the receive mode, and switches 84, 86 are opened by bias signal 82 to provide an open circuit at the origins 22*a*, 26*a* of the bifilar loops when communications terminal 10 is in the transmit mode.

As will be understood by those of skill in the art, such switching means need not actually provide a true open circuit in order to effectively isolate the antenna from the "OFF" network which is not in use; instead they need only provide sufficient impedance such that only a minimal amount of energy is coupled into the "OFF" network. While those of skill in the art will recognize that various electrical, electro-mechanical, or mechanical switches can be used to provide such an open circuit, electrical switches are preferred due to their reliability, low cost, small physical volume and ability to switch on and off at the high speeds required by emerging digital communications modes of operation. These electrical switches can readily be implemented as small surface mount devices on the stripline or microstrip printed circuit board that contains the transmit and receive antenna feed networks 51, 61. In one embodiment of the present invention, switching means 74, 76; 84, 86 are implemented as PIN diodes.

A PIN diode is a semiconductor device that operates as a variable resistor over a broad frequency range from the high frequency band through the microwave frequency bands. These diodes have a very low resistance, of less than 1 ohm, when in a forward bias condition. Alternatively, these diodes may be zero or reverse biased, where they behave as a small capacitance of approximately one picofarad shunted by a large resistance of as much as 10,000 ohms. Thus, in forward bias mode, the PIN diode acts as a short-circuit, while in reverse bias mode, the PIN diode effectively acts as an open-circuit. In one embodiment of the present invention, switches 74, 76; 84, 86 are implemented as discrete PIN diodes mounted on a stripline or microstrip printed circuit board which are coupled to the origins 22*a*, 26*a* of the bifilar loops that comprise quadrifilar helix antenna 20.

In this embodiment, when communications handset 10 is in receive mode, a D.C. bias current is applied to each PIN diode in the transmit circuit branch where it reverse biases these diodes thereby creating an open circuit at the origin of elements 22, 26 of quadrifilar helix antenna 20. At the same time, a forward control current is applied to the PIN diodes in the receive circuit branch creating a lower resistance connection to the receive circuit branch. Consequently, the receive circuit branch PIN diodes operate in forward bias mode, thereby coupling antenna 20 to receiver 14. As will readily be understood by those of skill in the art, when the user terminal 10 is operating in transmit mode, a reverse bias control voltage is applied to the PIN diodes in the receive circuit branch and a forward bias to the PIN diodes in the transmit circuit branch, thereby coupling antenna 20 to the transmitter 12 and creating an open-circuit between quadrifilar helix antenna 20 and receive circuit branch 42, 44, 61, 14.

As indicated in FIG. 4, in a preferred embodiment, Gallium arsenide field effect transistors (GaAs FETs) may alternatively be used to implement switches 74, 76; 84, 86. These devices may be preferred over PIN diodes because they operate in reverse bias mode when a bias signal is absent, thereby avoiding the power drain inherent with PIN diodes which require a bias current for forward bias operation. Moreover, as shown in FIG. 4, each GaAs FET uses an inductor to anti-resonate and therefore isolate the switch in the "OFF" mode. This operation significantly increases the electrical isolation of the "OFF" circuits. In the "ON" mode, the inductor is rendered desirably ineffective as it is shorted by the "ON" resistance of the associated GaAs FET. Furthermore, the drains and sources of the GaAs FET switches are operated at direct current ground potential and resistance. This attribute renders these GaAs FET free from ordinary electrostatic discharge concerns typically associated with use of GaAs FET near antenna circuitry. Moreover, in the embodiment of FIG. 4, a pair of radio frequency GaAs FET switches are used in both the transmit and receive modes, as the circuit arrangement is such that two switches are coupled to each of the bifilar loops 22, 26; 24, 28. Accordingly, the power handled by each switch 74, 76, 84, 86 is only half the power which would be required if a single switch was used to isolate each of the separate circuit branches. This is significant because currently available GaAs FETs have a power level above which undesired signal compression can occur, and the embodiment of FIG. 4 reduces the possibility of this occurring by requiring that only half the power pass through each GaAs FET switch 74, 76, 84, 86. In this embodiment, the GaAs FET switches 74, 76, 84, 86 are implemented as surface mount components on the stripline printed circuit board containing the transmit and receive 90° hybrid couplers 51, 61.

As illustrated in FIG. 4, typically, the transmission signal source 12 is coupled to the transmit 90° hybrid coupler 51 through a coaxial cable 53. Coaxial cable typically has an impedance of approximately 50 ohms. In order to maximize the energy transfer from transmission signal source 12 to quadrifilar helix antenna 20, it is preferable to match the impedance of the transmission source 12 and the impedance of antenna 20. In the case where the transmission source 12 is coupled to antenna 20 via 50 ohm coaxial cable, such matching can be accomplished by using known techniques to raise the impedance of antenna elements 22, 24 to approximately 50 ohms, and implementing resistor 59 as a 50 ohms resistor. As the $\lambda/2$ length antenna elements 22, 24, 26, 28 implemented in a preferred embodiment of the present invention have a resistance of approximately 4–12 ohms at resonance, an impedance transformation of approximately a factor of four is necessary to match the impedance of quadrifilar helix antenna 20 to the impedance at the input of transmit 90° hybrid coupler 51.

As illustrated in FIG. 4, such an impedance transformation may be provided by radio frequency baluns 92, 96 which include four to one transformers. As will be understood by those of skill in the art, such a balun may be implemented as $\lambda/4$ coaxial balun with a 4:1 impedance transformation or by various other balun implementations. By implementing impedance transformation means 92, 96 as coaxial 4:1 baluns, it is possible to transform the impedance of each antenna element 22, 24, 26, 28 to approximately 50 ohms to match the impedance of transmitter 12 and receiver 14. However, while a coaxial 4:1 balun is one potential method of implementing devices 92, 96, those of skill in the art will recognize that there are a variety of techniques which can be used to accomplish this impedance transformation, such as the use of a variety of small surface mount radio frequency transformers or ferrite core transformers, or through modifications to impedance matching bandpass networks 102, 104, 106, 108.

As will be understood by those of skill in the art, radio frequency transformers 92, 96, while not required, also may help solve component realization problems since by increasing the resonant resistance of antenna elements 22, 24, 26, 28 from 4–12 ohms to approximately 50 ohms, the inductance values are effectively raised by a factor of four, further helping to solve potential component realization problems as small inductance values and large capacitance values may be difficult to control in high volume manufacturing situations.

Finally, in the embodiment of FIG. 4 two separate antenna feed networks 51, 61 are provided, which operate to couple quadrifilar helix antenna 20 to transmitter 12 and receiver 14, respectively. These feed networks operate in an identical fashion to feed network 51, which was described earlier with reference to FIG. 3. Similarly, two additional impedance matching networks 106, 108 are also provided, which generally operate as described earlier with reference to matching networks 102, 104.

The antenna system depicted in FIG. 4 operates as follows. When communications handset 10 is in the receive mode, bias signal 72 activates the transmit circuit disconnect switches 74, 76 to open-circuit the electrical connection between transmit network 32, 34, 51, 12 and quadrifilar helix antenna 20 in order to electrically isolate the transmit circuit branch 32, 34, 51, 12 from the antenna 20. Similarly, when user handset 10 is in the transmit mode, bias signal 82 activates the receive circuit disconnect switches 80 in order to electrically isolate the receive network 42, 44, 61, 14 from antenna 20. During periods of transmission, coupling means 51 feed a source signal from transmitter 12 to quadrifilar helix antenna 20, whereas in receive mode coupling means 61 operate to combine the signal received by the elements of the quadrifilar helix antenna 20 and feeds this combined signal to receiver 14.

In a preferred embodiment of the present invention, the 90° hybrid couplers 51, 61 50 ohm resistors 59, 68, GaAs FET switches 74, 76, 84, 86, impedance matching circuits 102, 104, 106, 108, first and second circuit branches 32, 34, 42, 44 and balun-transformers 92, 96 are all implemented as surface mount components on a stripline or microstrip printed circuit board. Preferably, a multilayer board is used which includes a ground circuit between its top and bottom layers, and the components of the 0° legs of the transmit and receive branch are mounted on one side of the board while the components of the 90° legs of the transmit and receive branch are mounted on the opposite side of the printed circuit board. At one end of the printed circuit board, four contacts may be provided to couple the elements of quadrifilar helix antenna 20 to the antenna feed circuitry. On the other end of the printed circuit board, provision may be made for attaching the coaxial transmission lines from the transmitter 12 and receiver 14.

In a preferred embodiment, a flexible microelectronic substrate is employed, which is meandered to fit completely within the cylindrical structure which houses quadrifilar helix antenna 20. As discussed above, quadrifilar helix antenna 20 may also be implemented on a flexible planar substrate which is similarly rolled to form the helical antenna elements 22, 24, 26, 28. The planar substrate on which antenna 20 is formed in this embodiment may be substrate 132 or a separate substrate which is electrically connected to substrate.

Moreover, by implementing antenna system 18 on one or more microelectronic substrates that are completely contained within the housing for the antenna, it is possible to place the antenna feed and matching networks in extremely close proximity to quadrifilar helix antenna 20, thereby minimizing the amount of stray inductance added by the electrical connections between such matching/feed networks and antenna 20. Preferably, all the elements of the feed circuits, matching circuits and other non-antenna components of antenna system 18 are positioned less than 5 centimeters from the origin of antenna 20. More preferably, these components are positioned less than 3 centimeters from the origin of antenna 20.

Use of a meandered flexible microelectronic substrate may significantly reduce the volume required by quadrifilar helix antenna system 18. By way of example, the embodiment of FIG. 4, when implemented as a 10 millimeter in diameter, $\lambda/2$ element quadrifilar helix antenna designed to operate at approximately 1600 MHz, may fit within a cylinder 13 centimeters long and 10 millimeters in diameter. Thus, at L-Band, quadrifilar helix antennas according to the present invention may easily be designed to fit within a volume of 11 cubic centimeters, which is significantly smaller than many prior art quadrifilar helix antennas which provide bandwidth and/or gain performance characteristics inferior to the antennas of the present invention.

In the drawings, specification and examples, there have been disclosed typical preferred embodiments of the invention and, although specific terms are employed, these terms are used in a generic and descriptive sense only and not for purposes of limitation, the scope of the invention being set forth in the following claims. Accordingly, those of skill in the art will themselves be able to conceive of embodiments of the antenna system other than those explicitly described herein without going beyond the scope of the present invention.

That which is claimed is:

1. An antenna system for a handheld transceiver for transmitting signals in the 1626.5 MHz to 1660.5 MHz frequency band and for receiving signals in the 1525 MHz to 1559 MHz frequency band comprising:

(a) a quadrifilar helix antenna having four antenna elements, wherein a diameter of a cylinder defined by said antenna is between 6 and 13 millimeters;

(b) means for coupling signals between said quadrifilar helix antenna and a transceiver; and (c) at least one reactive matching element coupled to said quadrifilar helix antenna for increasing the operating bandwidth of said quadrifilar helix antenna (d) wherein a voltage standing wave ratio as measured at the output of said transceiver is less than 1.5 for a continuous bandwidth of at least 25 MHz in both the 1626.5 MHz to 1660.5 MHz and 1525 MHz to 1559 MHz frequency bands.

2. The antenna system of claim 1, wherein each of said antenna elements comprises a filar helix with a pitch angle greater than about 55 degrees and less than about 85 degrees.

3. The antenna system of claim 1, wherein a volume required by said quadrifilar helix antenna and said at least one reactive matching element is less than 11 cubic centimeters.

4. The antenna system of claim 1, further comprising a flexible microelectronic substrate, and wherein said quadrifilar helix antenna and said at least one reactive matching element are implemented on said flexible microelectronic substrate.

5. An antenna system for a handheld transceiver for transmitting and receiving radio frequency signals in the L-Band frequency band comprising:

(a) a quadrifilar helix antenna having four antenna elements, wherein an axial length of each element is between 7 and 9 centimeters and a diameter of a cylinder defined by said antenna is between 6 and 13 millimeters, wherein said antenna elements each have an origin and a distal end, and wherein the origin of said first and third antenna elements are coupled to said transceiver, and the origin of said second and fourth antenna elements are coupled to a first reference voltage, and wherein said first and second antenna elements are electrically connected at their distal ends and said third and fourth antenna elements are electrically connected at their distal ends; and (b) means for coupling signals between said quadrifilar helix antenna and said transceiver.

6. The antenna system of claim 5, wherein said antenna elements are of a length that provides for resonant operation at a frequency in the frequency band over which said handheld transceiver is to operate.

7. The antenna system of claim 5, wherein each antenna element is approximately 0.5 the wavelength ($\lambda$) of operation of said quadrifilar helix antenna.

8. The antenna system of claim 5, wherein said antenna elements are arranged orthogonally and excited in phase quadrature.

9. The antenna system of claim 5, wherein said quadrifilar helix antenna is configured to transmit and receive circularly polarized signals.

10. The antenna system of claim 5, wherein the elements of said quadrifilar helix antenna define a cylinder with a constant diameter which is less than 10% the wavelength ($\lambda$) of operation of said quadrifilar helix antenna.

11. The antenna system of claim 5, wherein a voltage standing wave ratio as measured at the output of said transceiver is less than 1.5 for a continuous bandwidth of at least 1.7% of the frequency at which the antenna is designed to operate.

12. The antenna system of claim 11, wherein a volume required by said quadrifilar helix antenna and said matching means is less than 11 cubic centimeters.

13. The antenna system of claim 5, wherein each of said antenna elements comprises a filar helix with a pitch angle greater than about 55 degrees and less than about 85 degrees.

14. The antenna system of claim 5, further comprising reactive matching means coupled to said quadrifilar helix antenna for increasing the operating bandwidth of said quadrifilar helix antenna.

15. The antenna system of claim 5, further comprising at least one reactive matching element coupled to said quadrifilar helix antenna for increasing the operating bandwidth of said quadrifilar helix antenna.

16. An antenna system for a handheld user transceiver for receiving radio frequency signals comprising:

(a) a quadrifilar helix antenna having four antenna elements for receiving radio frequency signals in the 1525 MHz to 1559 MHz frequency band with a directivity in excess of 3 dBi for all elevation angles exceeding 45°, wherein said antenna elements each have an origin and a distal end, and wherein the origin of said first and third antenna elements are coupled to said transceiver, and the origin of said second and fourth antenna elements are coupled to a first reference voltage, and wherein said first and second antenna elements are electrically connected at their distal ends and said third and fourth antenna elements are electrically connected at their distal ends, and wherein said antenna elements are arranged orthogonally and excited in phase quadrature and wherein an axial length of each element is between 7 and 9 centimeters and the diameter of the cylinder defined by said antenna is between 6 and 13 millimeters; and (b) means for coupling signals between said quadrifilar helix antenna and said transceiver.

17. The antenna system of claim 16, wherein each of said antenna elements comprises a filar helix with a pitch angle greater than about 55 degrees and less than about 85 degrees.

18. The antenna system of claim 16, further comprising matching means coupled to the elements of said quadrifilar helix antenna for increasing the operating bandwidth of said quadrifilar helix antenna.

19. The antenna system of claim 18, wherein a voltage standing wave ratio as measured at the output of said transceiver is less than 1.5 over the entire 1525 MHz to 1559 MHz frequency band.

20. The antenna system of claim 15, wherein a volume required by said quadrifilar helix antenna and said matching means is less than 2 cubic centimeters.

21. The antenna system of claim 15, further comprising at least one flexible microelectronic substrate, and wherein said quadrifilar helix antenna and said matching means are implemented on a flexible microelectronic substrate.

22. An antenna system for a handheld user transceiver for transmitting radio frequency signals comprising:

(a) a quadrifilar helix antenna having four antenna elements for transmitting radio frequency signals in the 1626.5 MHz to 1660.5 MHz frequency band with a directivity in excess of 3 dBi for all elevation angles exceeding 45°, wherein said antenna elements each have an origin and a distal end, and wherein the origin of said first and third antenna elements are coupled to said transceiver, and the origin of said second and fourth antenna elements are coupled to a first reference voltage, and wherein said first and second antenna elements are electrically connected at their distal ends and said third and fourth antenna elements are electrically connected at their distal ends, and wherein said antenna elements are arranged orthogonally and excited in phase quadrature and wherein an axial length of each element is between 7 and 9 centimeters and the diameter of the cylinder defined by said antenna is between 6 and 13 millimeters; and (b) means for coupling signals between said quadrifilar helix antenna and said transceiver.

23. The antenna system of claim 22, wherein each of said antenna elements comprises a filar helix with a pitch angle greater than about 55 degrees and less than about 85 degrees.

24. The antenna system of claim 22, further comprising matching means coupled to the elements of said quadrifilar helix antenna for increasing the operating bandwidth of said quadrifilar helix antenna.

25. The antenna system of claim 24, wherein a voltage standing wave ratio as measured at the output of said transceiver is less than 1.5 over the entire 1626.5 MHz to 1660.5 MHz frequency band.

26. The antenna system of claim 25, wherein a volume required by said quadrifilar helix antenna and said matching means is less than 11 cubic centimeters.

27. The antenna system of claim 24, further comprising at least one flexible microelectronic substrate, and wherein said quadrifilar helix antenna and said matching means are implemented on a flexible microelectronic substrate.

28. An antenna system for a handheld transceiver for transmitting and receiving radio frequency signals comprising:

(a) a quadrifilar helix antenna having four antenna elements, wherein an axial length of each element is between 0.37 and 0.48 the wavelength of operation and the diameter of the cylinder defined by said antenna is between 0.03 and 0.07 the wavelength of operation and wherein said antenna elements each have an origin and a distal end, and wherein the origin of said first and third antenna elements are coupled to said transceiver, and the origin of said second and fourth antenna elements are coupled to a first reference voltage and wherein said first and second antenna elements are electrically connected at their distal ends and said third and fourth antenna elements are electrically connected at their distal ends; and (b) means for coupling signals between said quadrifilar helix antenna and said transceiver.

29. The antenna system of claim 28, wherein said transceiver transmits signals in the 1626.5 MHz to 1660.5 MHz frequency band and receives signals in the 1525 MHz to 1559 MHz frequency band.

30. The antenna system of claim 28, wherein said antenna elements are of a length that provides for resonant operation at a frequency in the frequency band over which said handheld transceiver is to operate.

31. The antenna system of claim 28, wherein each of said antenna elements comprises a filar helix with a pitch angle greater than about 55 degrees and less than about 85 degrees.

32. The antenna system of claim 28, further comprising at least one reactive matching element coupled to said quadrifilar helix antenna for increasing the operating bandwidth of said quadrifilar helix antenna.

33. A handheld transceiver for transmitting and receiving radio frequency signals in the L-Band frequency band comprising:

(a) a transmitter;

(b) a receiver;

(c) a user interface;

(d) a quadrifilar helix antenna having four antenna elements, wherein an axial length of each element is between 7 and 9 centimeters and the diameter of the cylinder defined by said antenna is between 6 and 13 millimeters and wherein said antenna elements each have an origin and a distal end, and wherein the origin of said first and third antenna elements are coupled to said transceiver and the origin of said second and fourth antenna elements are coupled to a first reference voltage, and wherein said first and second antenna elements are electrically connected at their distal ends and said third and fourth antenna elements are electrically connected at their distal ends; and (e) means for coupling signals between said quadrifilar helix antenna and said transceiver.

34. The transceiver of claim 33, wherein said antenna elements are of a length that provides for resonant operation at a frequency in the frequency band over which said handheld transceiver is to operate.

35. The transceiver of claim 33, wherein each antenna element is approximately 0.5 the wavelength (λ) of operation of said quadrifilar helix antenna.

36. The transceiver of claim 33, wherein each of said antenna elements comprises a filar helix with a pitch angle greater than about 55 degrees and less than about 85 degrees.

37. The transceiver of claim 33, wherein said antenna elements are arranged orthogonally and excited in phase quadrature.

38. The transceiver of claim 33, wherein said quadrifilar helix antenna is configured to transmit and receive circularly polarized signals.

39. The transceiver of claim 33, further comprising reactive matching means coupled to said quadrifilar helix antenna for increasing the operating bandwidth of said quadrifilar helix antenna.

40. The transceiver of claim 39, wherein a voltage standing wave ratio as measured at the output of said transceiver is less than 1.5 for a continuous bandwidth of at least 25 MHz in the L-Band frequency band.

41. An antenna system for a handheld transceiver for transmitting and receiving radio frequency signals comprising:

(a) a quadrifilar helix antenna having four antenna elements, wherein a diameter of a cylinder defined by said antenna is between 0.03 and 0.07 of a wavelength corresponding to a frequency at which the antenna is designed to operate;

(b) means for coupling signals between said quadrifilar helix antenna and said transceiver; and (c) at least one reactive matching element coupled to said quadrifilar helix antenna for increasing the operating bandwidth of said quadrifilar helix antenna so that a voltage standing wave ratio as measured at the output of said transceiver is less than 1.5 for a continuous bandwidth of at least 1.7% of a frequency at which the antenna is designed to operate;

(d) wherein said transceiver is configured to transmit signals in the 1626.5 MHz to 1660.5 MHz frequency band and receive signals in the 1525 MHz to 1559 MHz frequency band.

42. The antenna system of claim 41, wherein said quadrifilar helix antenna has a directivity in excess of 3 dBi for all elevation angles exceeding 45° over said continuous bandwidth of at least 1.7% of the frequency at which the antenna is designed to operate.

43. The antenna system of claim 41, wherein a volume required by said quadrifilar helix antenna and said matching means is less than 11 cubic centimeters.

44. The antenna system of claim 41, further comprising a flexible microelectronic substrate, and wherein said quadrifilar helix antenna and said at least one reactive matching element are implemented on said flexible microelectronic substrate.

45. The antenna system of claim 41, wherein an axial length of each element is between 0.37 and 0.48 the wavelength of operation.

* * * * *

UNITED STATES PATENT AND TRADEMARK OFFICE

CERTIFICATE OF CORRECTION

PATENT NO. : 5,920,292

DATED : July 6, 1999

INVENTOR(S) : Gregory A. O'Neill, Jr.

It is certified that error appears in the above-identified patent and that said Letters Patent is hereby corrected as shown below:

On the Cover - Other Publications

Mikael Öhgren Delete "Docunment" and substitute -- Document -- therefor.

Column 19, line 42 Please delete "15" and substitute -- 18 -- therefor.
Column 19, line 62 Please delete "an" and substitute -- the -- therefor.

Signed and Sealed this

Fourth Day of April, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

| | | |
|---|---|---|
| PATENT NO. | : | 5,920,292 |
| DATED | : | July 6, 1999 |
| INVENTOR(S) | : | Gregory A. O'Neill, Jr. |

It is certified that error appears in the above-identified patent and that said Letters Patent is hereby corrected as shown below:

In The Claims:

Column 19, line 39 Please delete "15" and substitute -- 18 --therefor.

Column 19, line 42 Please delete "15" and substitute -- 18 -- therefor.

Signed and Sealed this

Ninth Day of May, 2000

*Attest:*

Q. TODD DICKINSON

*Attesting Officer*

*Director of Patents and Trademarks*